United States Patent [19]

Guillory

[11] Patent Number: 4,669,683

[45] Date of Patent: Jun. 2, 1987

[54] MOVEABLE SAFETY RAILING

[76] Inventor: Lloyd J. Guillory, P.O. Box 2566, Morgan City, La. 70381

[21] Appl. No.: 835,666

[22] Filed: Mar. 3, 1986

[51] Int. Cl.[4] ..... B64F 1/36; E04G 5/00

[52] U.S. Cl. ..... 244/114 R; 244/110 E; 256/1; 182/19; 182/113; 114/258

[58] Field of Search ..... 244/114 R; 114/258, 114/261; 256/1; 182/19, 113; 43/59, 60, 61; 109/3

[56] References Cited

U.S. PATENT DOCUMENTS

| | | | |
|---|---|---|---|
| 166,802 | 8/1875 | Oliver | 109/3 |
| 1,433,419 | 10/1922 | Schleier . | |
| 1,852,642 | 4/1932 | Borba | 43/59 |
| 2,053,035 | 9/1936 | Jackson et al. | 43/59 |
| 2,481,343 | 9/1949 | Redstone . | |
| 2,920,846 | 1/1960 | Lingafelter . | |
| 3,037,727 | 6/1962 | Grundy . | |
| 3,147,940 | 9/1964 | Laufer . | |
| 3,693,754 | 9/1972 | Butler | 182/113 |
| 4,116,408 | 9/1978 | Soloy . | |
| 4,202,646 | 5/1980 | Herstad . | |
| 4,255,911 | 3/1981 | Beacom et al. . | |
| 4,374,584 | 2/1983 | Pokhis et al. | 256/1 |
| 4,467,888 | 8/1984 | Hickling | 182/19 |
| 4,474,130 | 10/1984 | Birkeland . | |

*Primary Examiner*—Galen Barefoot

*Attorney, Agent, or Firm*—Jones, Tullar & Cooper

[57] ABSTRACT

A pivotable safety railing for a platform such as a helicopter landing pad is disclosed. The safety railing includes a suitable hand railing of sufficient height to protect a person on the landing pad, and mounted on a pivot shaft extending along an edge of the platform. The pivot shaft allows the railing to pivot downwardly to a horizontal position while a helicopter is landing or taking off, and to pivot upwardly to an upright, or vertical, position, when a helicopter is resting on the landing pad. The pivot shaft is driven by a suitable electric motor which is controlled by sensors located on the landing pad, the sensors causing the pivot shaft to be driven in a direction to move the railing to its horizontal position whenever there is no helicopter present on the pad, and causing the shaft to be driven in a direction to raise the railing to its vertical position whenever a helicopter has landed. The railing preferably is located adjacent a stairway leading to the platform, to provide a handrail for passengers entering or leaving the landing area, but, if desired, may be provided along other areas of the landing pad, as required for safety purposes.

16 Claims, 7 Drawing Figures

MOVEABLE SAFETY RAILING

BACKGROUND OF THE INVENTION

The present invention relates to safety railings for helicopter landing pads, or helipads, and particularly to a pivotable railing normally in a horizontal position flush with or slightly below the surface of the landing pad and responsive to the landing of a helicopter to pivot into an upright position for protecting passengers entering or leaving the landing area.

Helicopter landing pads are often located on elevated platforms, sometimes for reasons of limitations in available space, but more often to elevate the landing surface above surrounding obstructions so as to facilitate landing and taking off. Helicopter landing pads are commonly utilized on offshore drilling rigs, for example, and typically are elevated above surrounding structures on the rig to provide a clear path for the helicopter during takeoff and landing. In addition to their location above and away from nearby obstacles, the structure of such helipads is further restricted by the requirement that no projection can extend more than six inches above the surface of the helipad, again for the safety of the helicopter crew and passengers.

Such helipads are typically reached by means of stairways which, for the safety of the users, require the provision of handrails. However, because of the rule prohibiting projections above the surface of the helipad, the top few stairs and any landing at the top of the stairs cannot now have such handrails. This is extremely hazardous to persons entering or leaving the helicopter pad area, particularly in exposed areas where adverse weather conditions might be encountered. The hazardous nature of such pads is exemplified by the fact that, as a normal precaution, safety nets are usually hung around the perimeter of the helipad. However, for high-use areas, such as the stairways and landings leading to the helipad, an urgent need exists for additional safety equipment.

SUMMARY OF THE INVENTION

An object of the present invention is to improve the safety of helipads.

A further object of the present invention is to provide a safety mechanism adjacent the stairways and stairway landing areas of elevated platforms on which helipads are located.

A still further object of the present invention is to provide safety equipment for helipads which will protect passengers and others entering and leaving the helicopter landing area, yet which will meet the restriction against projections extending above the level of the landing pad during takeoff and landing of a helicopter.

In accordance with the present invention, a safety device is provided for helipads which will retract during landing and takeoff of a helicopter so as to ensure the safety of that aircraft, but which will extend into an operable position upon landing of the helicopter to protect the passengers and others entering and leaving the helipad area. More specifically, the invention provides a pivotally mounted safety railing which is moveable between a normal retracted position, wherein it is horizontally disposed and level with, or below, the surface of the helipad, and an upright, or operational position wherein the railing extends vertically to provide protection for passengers and others who are entering or leaving the helipad area.

In its preferred form, the safety device of the present invention include a handrail having vertical posts mounted for pivotal motion on a pivot shaft. The pivot shaft is mounted along the outer edge of a platform area such as a stairway landing, with the pivot shaft being suitably journalled in the support structure for the landing. A reversible electrical drive motor rotates the pivot shaft in a first direction to pivot the railing downwardly to its retracted, or horizontal, position, where it remains when there is no helicopter present on the helipad. This is the normal position of the safety railing. When a helicopter is present on the helipad, sensors activate the drive motor to cause it rotate the shaft in a second, or reverse, direction to raise the railing up to a vertical, or operational, position, where it is held until a sensor detects that the helicopter has lifted off the pad. Sensing of the presence of a helicopter preferably is accomplished by means of pressure-sensitive switches located on the helipad surface. Such sensors are sensitive to the weight of the helicopter to activate the motor to raise or lower the railing, as required. The drive motor is operated by the sensors on the helipad through a suitable reversing switch mechanism which responds to position detectors, such as microswitches, sensitive to the position of the railing. The drive motor can be a linear motor connected to the pivot shaft through a cam arm, or, in the preferred form of the invention, can be a rotary motor connected to the pivot shaft through suitable reducing gears.

In its preferred form, the safety railing extends along the outermost edge of a stairway landing platform, with a portion of the handrail extending along the stairway itself to provide a handrailing for the uppermost stairs. If desired, similar safety railings can be provided along any part of the perimeter of the helipad, or around the entire helipad, if desired.

BRIEF DESCRIPTION OF DRAWINGS

The foregoing and additional objects, features, and advantages of the present invention will become apparent to those of skill in the art from a consideration of the following detailed description of a preferred form thereof, taken in conjunction with the accompanying drawings, in which.

DESCRIPTION OF PREFERRED EMBODIMENT

Figure 1:
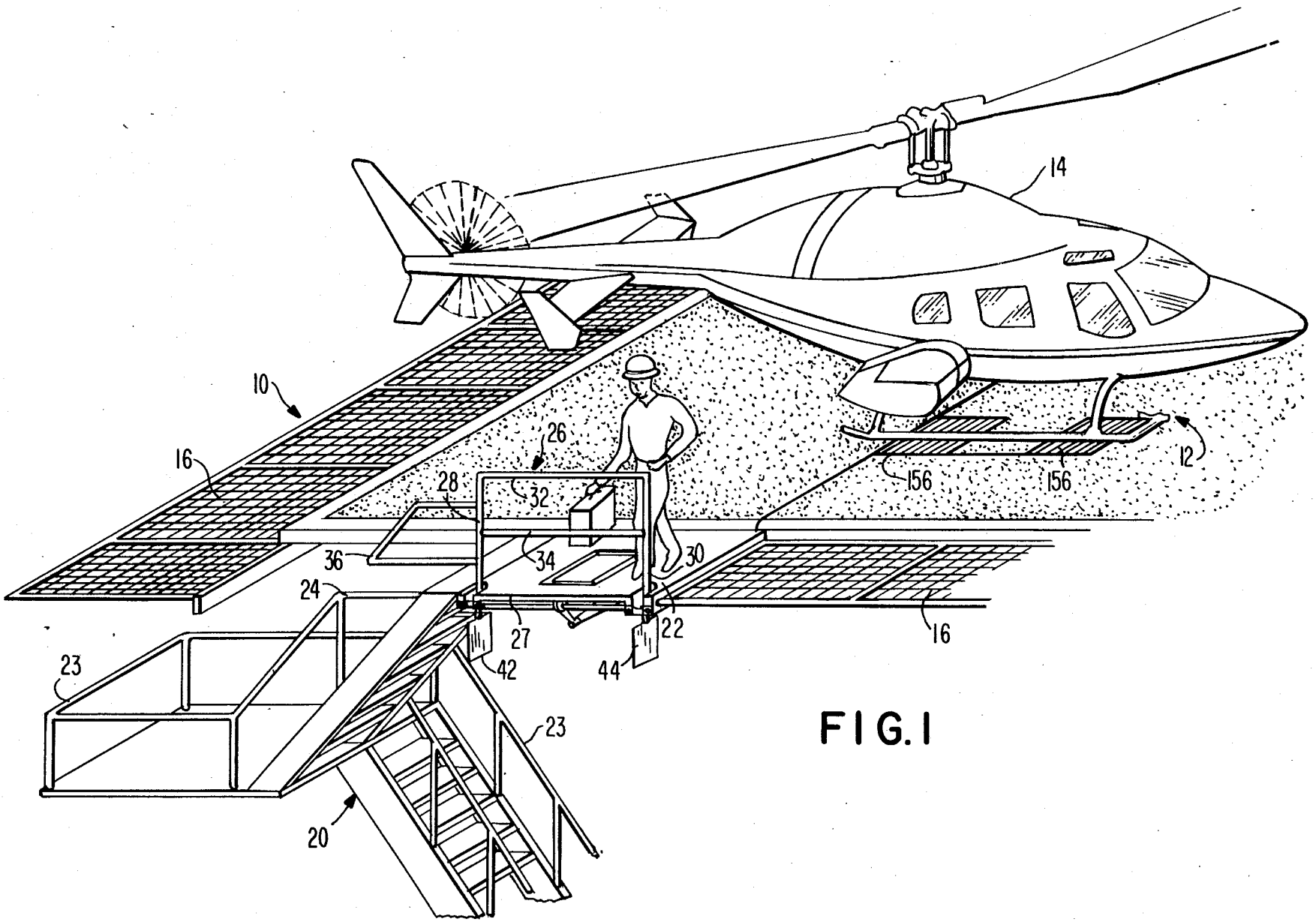
FIG. 1 is a diagrammatic, prospective view of a helipad incorporating one embodiment of the safety railing of the present invention.

Turning now to a more detailed consideration of the present invention, there is illustrated in FIG. 1 a helicopter landing platform, or helipad 10, of conventional construction, and having a landing area, generally designated at 12, on which a helicopter 14 may land or from which it may take off. The helipad 10 is shown as including safety netting 16 around the perimeter thereof to protect personnel on the helipad, but below the horizontal surface of the landing platform. Access to the helipad is by way of a stairway 20 leading to a stairway landing 22 adjacent and secured to the helipad 10. The stairway preferably includes handrails 23 which extend along the edge thereof, but which terminate near the top of the stairway, as indicated at railing section 24, because of the prohibition against obstructions extending above the surface of the helipad 10. Because of this prohibition, the top few stairs of stairway 20 and the stairway landing 22 included no protection for users seeking to enter or leave the helicopter landing area, prior to the present invention.

In accordance with the present invention, a retractable railing 26 is provided along the outer edge 27 of the stairway landing 22. The railing 26, which is shown in its activated position, includes, for example, a pair of spaced, vertical posts 28 and 30, pivotally mounted at opposite ends of the stairway landing 22, with horizontal rails 32 and 34 extending therebetween. A railing extension 36 is connected to the vertical post 28, and extends the railing over the outer edge of the stairway 20, and above the railing section 24, to supplement the stairway railing 23 for the upper portion thereof, so that persons using the stairway will be protected above the level of the helipad surface when the safety railing 26 is in its operational position.

Figure 2:
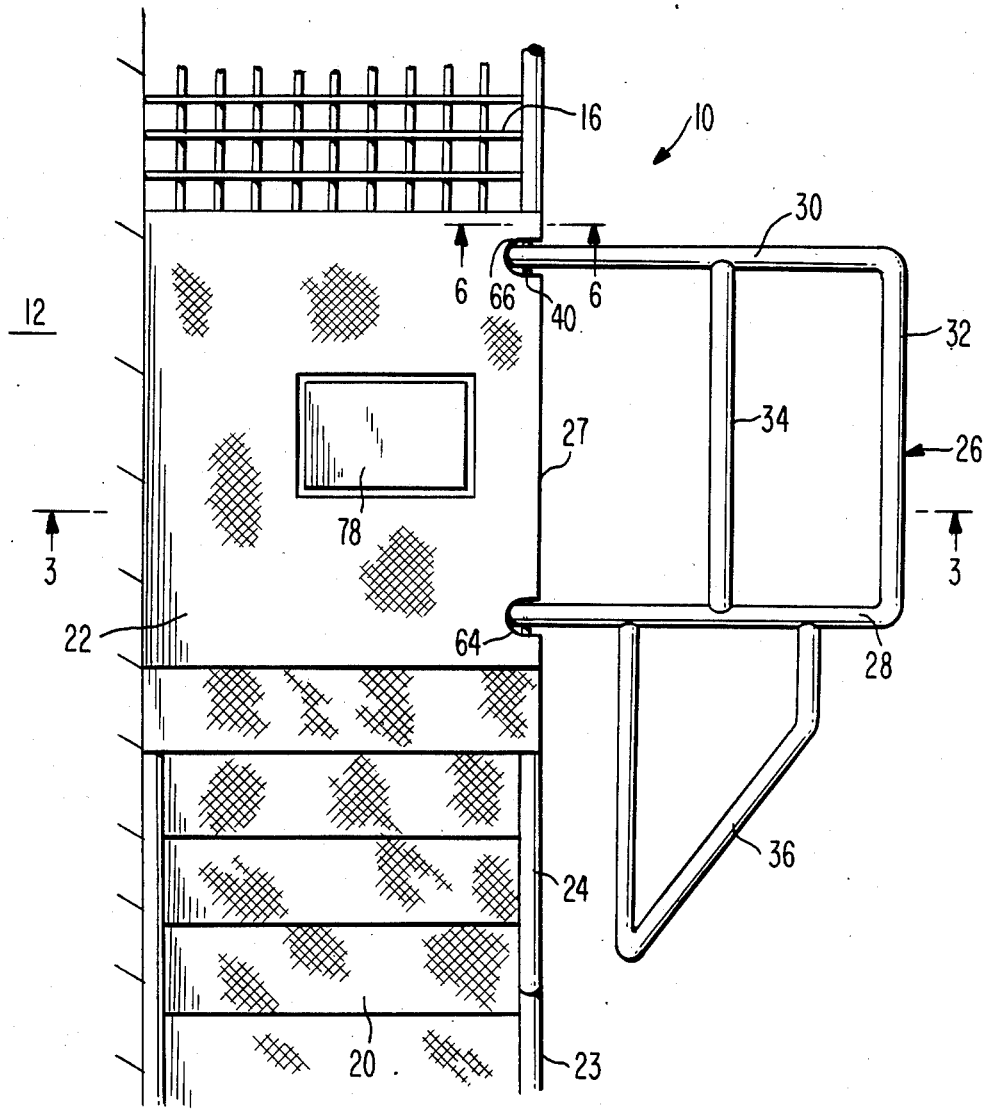
FIG. 2 is partial top plan view of the helipad of FIG. 1, showing the stairway and stairway landing platform with the safety railing in its normal, or retracted, position.
Figure 3:
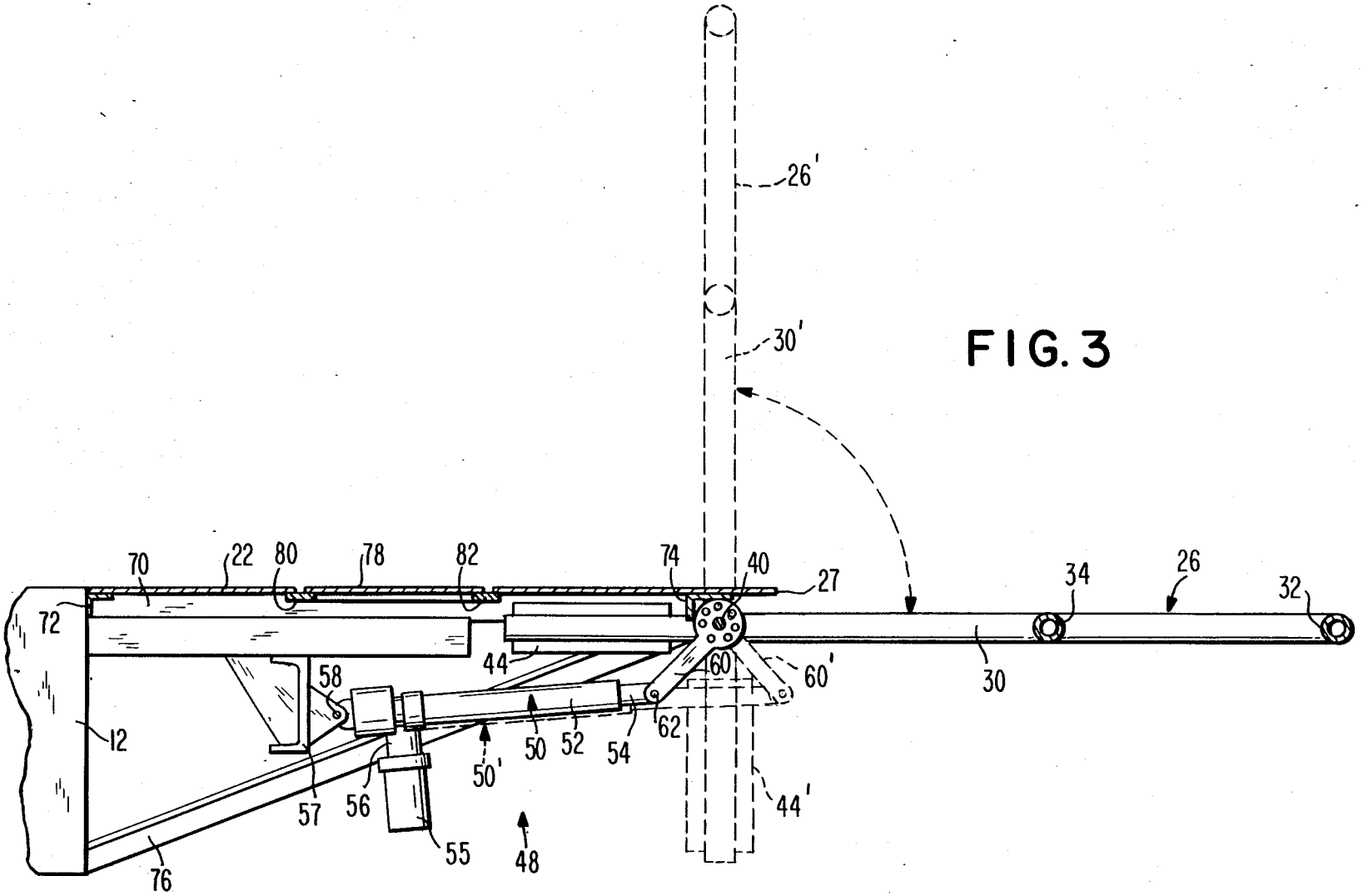
FIG. 3 is a cross-sectional view taken along line 3—3 of FIG. 2.

FIG. 2 is a top plan view of the stairway landing 22, showing a few of the stairs on stairway 20, and showing a part of the safety net 16. In this view, the railing 26 is shown in its normal, or retracted, position, wherein it is horizontal and slightly below the surface of platform 22, as is better illustrated in FIG. 3. The railing 26 is mounted on a pivot shaft 40 which extends generally along the edge 27 of landing 22. Preferably, the pivot shaft extends through the posts 28 and 30, which are secured for rotation with the shaft, as by welding. As shown in FIG. 3, the pivot shaft 40 is parallel to and slightly below the surface of stairway landing 22, and preferably is located slightly behind the front edge 27, this location of the shaft being preferred to permit the railing to freely pivot in the manner illustrated. In this embodiment, the bottom ends of posts 28 and 30 extend below the pivot shaft 40 and carry counterweights 42 and 44 (see FIGS. 1 and 3) which serve to balance the weight of the railing portion which extends above the stairway landing 22, to thereby facilitate movement of the railing between its retracted and its operational positions. In FIG. 3, the normal, or retracted, position is shown in solid lines, with the vertical, or activated, position being shown in phantom at 26'.

A drive mechanism 48 operates the pivot shaft 40 to raise and lower the railing. The drive mechanism may take several forms, and is shown in FIG. 3 as including a telescoping arm 50 having an outer cylinder 52 and an extendable inner shaft 54. The arm 50, which may be referred to as a linear motor, is driven by an electric motor 55 through suitable gears 56 to extend and contract, depending on the direction of rotation of motor 55. The arm 50, motor 55, and gears 56 are mounted on a bracket 57 secured to the understructure of stairway landing 22, and are connected thereto by means of a pivot pin 58 so that the arm 50 is free to move in a vertical direction as the railing is raised and lowered, as illustrated at 50' by the dotted line. Shaft 54 is connected at its outer end to a crank arm 60 by way of a pivot pin 62, so that extension and contraction of the linear motor mechanism 50 pivots the crank arm 60 clockwise or counterclockwise, respectively, as viewed in FIG. 3, to raise or lower the railing 26. When the telescoping arm 50 is withdrawn to its contracted position, the shaft 40 is rotated in a clockwise direction to position the railing in the horizontal location shown in solid lines in the figure. Extension of the telescoping arm 50 causes the crank arm 60 to be rotated in a counterclockwise direction to the position illustrated in dotted lines at 60', raising the railing to the vertical position 26'. When the railing pivots to its vertical position, the posts 28 and 30 extend upwardly through slots 64 and 66 in the stairway landing 22, illustrated in FIG. 2.

As shown in FIG. 3, the stairway landing 22 is supported by suitable framing such as the angle irons illustrated at 70, 72, and 74, as well as the angled braces illustrated at 76. This understructure secures the stairway landing to the side of the helipad structure 12, in conventional manner. As a matter of convenience, the landing 22 may be provided with a hatch 78 which can be opened to permit access to the linear motor 50, its drive motor 55, and the gears 56. The hatch is supported in the landing by means of plates 80 and 82 secured to the bottom of platform 22.

Figures 4, 6:
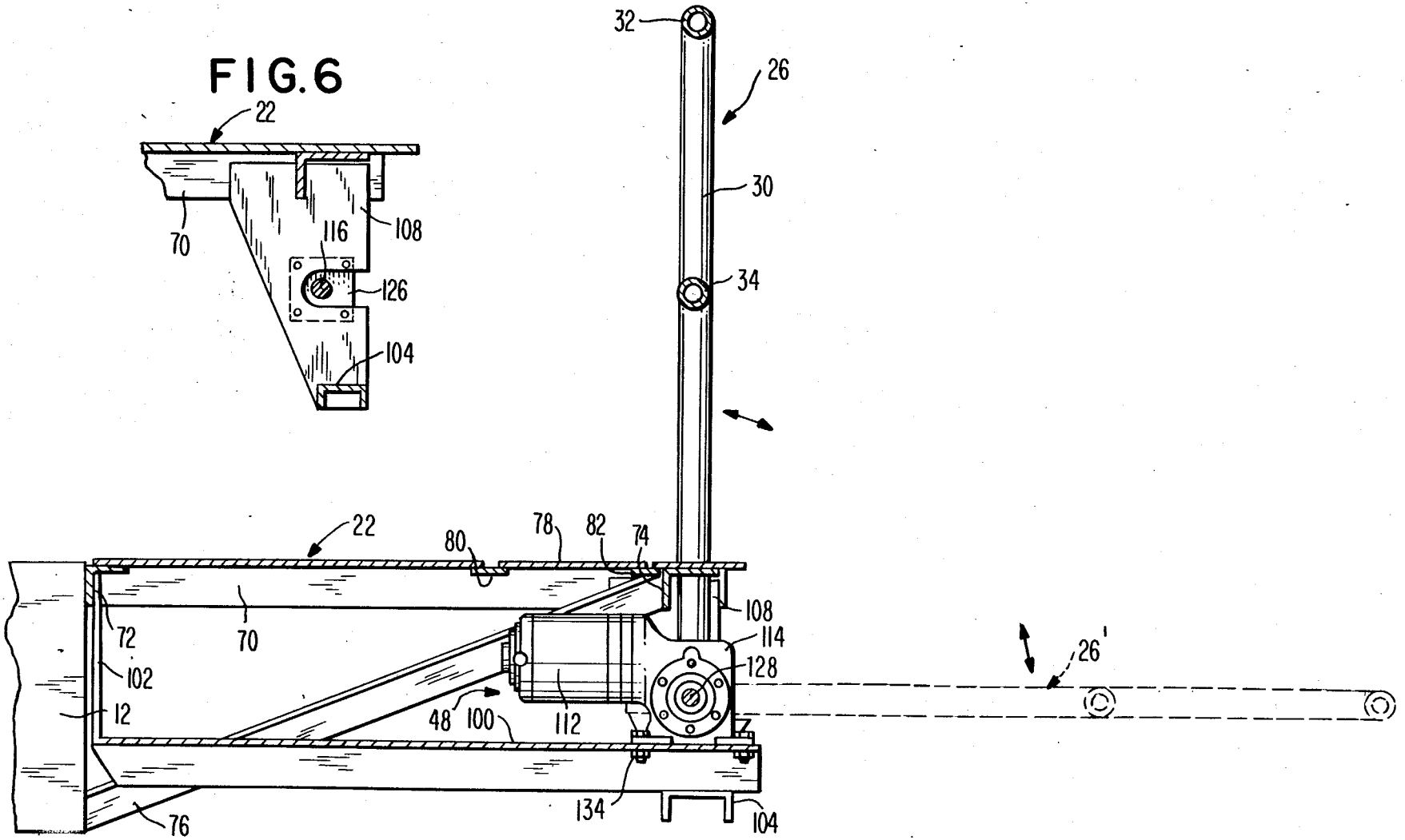
FIG. 4 is a cross-sectional view taken along line 3—3 of FIG. 2, showing a modified version of the drive motor, and showing the railing in an upright position.
FIG. 6 is a partial sectional view taken along line 6—6 of FIG. 2.
Figure 5:
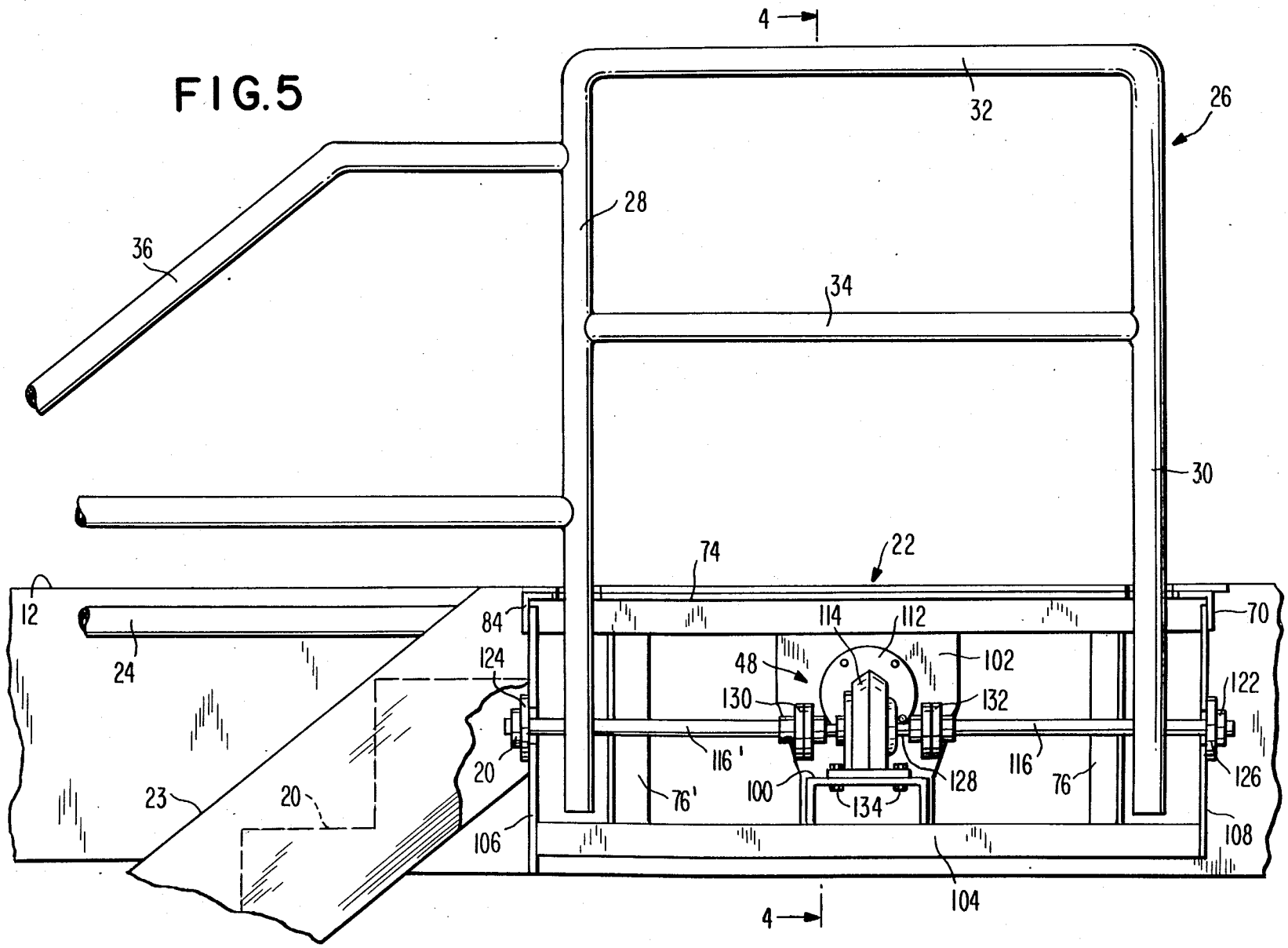
FIG. 5 is a front elevation view of the modified version of the safety railing and drive mechanism of FIG. 4.

A preferred form of the invention is illustrated in FIGS. 4 and 5, to which reference is now made. In these figures, elements common to the embodiment of FIGS. 2 and 3 are similarly numbered. Thus, the stairway landing 22 is secured to the front edge of the helipad 12 as by means of angle iron 72, and is supported by angle irons 70, 74, and 84, as well as support braces 76 and 76', all as previously illustrated. Various other angle irons and supports may be provided, as required, to provide the required load support for the landing platform 22, in conventional manner. Secured under the stairway landing is a drive mechanism support platform 100, the platform being held in place by means of a rear bracket 102 suspended from angle iron 72 (see FIG. 4) and a front channel bar 104 extending across the landing platform and welded, or otherwise fastened, to the bottom edges of a pair of side support brackets 106 and 108. The side support brackets are secured at their upper ends, as by welding, to the angle irons 84 and 70, respectively. Platform 100 forms a support for the drive mechanism 48, which in this embodiment consists of an electrical drive motor 112 connected to a suitable reduction gear mechanism 114 which, in turn, engages a pair of pivot shafts 116' and 116 on which the railing 26 is mounted. The pivot shafts 116' and 116 are journalled at their outer ends in bearings 120 and 122 carried by bearing plates 124 and 126 secured to the angle irons 84 and 70 (see FIGS. 5 and 6). The pivot shaft 116 may be the output shaft of gear mechanism 114, or may consist of a pair of pivot shafts 116 and 116' coupled to a gear mechanism output shaft 128 by way of couplers 130 and 132, as illustrated in FIG. 5.

The drive motor 112 and the gear mechanism 114 are secured to the support platform 100 by suitable bolts 134. Access to the drive motor and gear mechanism may be provided by way of hatch 78 which is mounted, for example, on support irons 80 and 82, illustrated in FIG. 4.

As most clearly shown in FIG. 5, the vertical posts 28 and 30 of the railing 26 are mounted on pivot shafts 116' and 116, and are secured for rotation therewith, as by welding. As illustrated, the posts 28 and 30 are mounted at opposite ends of shafts 116' and 116, adjacent the journals 120 and 122, so that the journals provide firm support for the railing and pivot shaft. As before, the railing may be rotated between its vertical position, illustrated in FIGS. 4 and 5 by solid lines, and its horizontal position, illustrated in dotted lines in FIG. 4. The electric motor 112 is activated to drive the shafts 116' and 116 in one direction or the other through the gear mechanism 114 to raise or lower the railing, as required. In this embodiment, the railing posts 28 and 30 extend just a short distance below the shafts 116' and 116, the counterweights 42 and 44 being eliminated. Although this requires a more powerful drive mechanism 48, since the shafts 116' and 116 must lift the entire weight of the railing, it has the advantage of being more compact than the arrangement illustrated in FIGS. 1 and 3.

Figure 7:
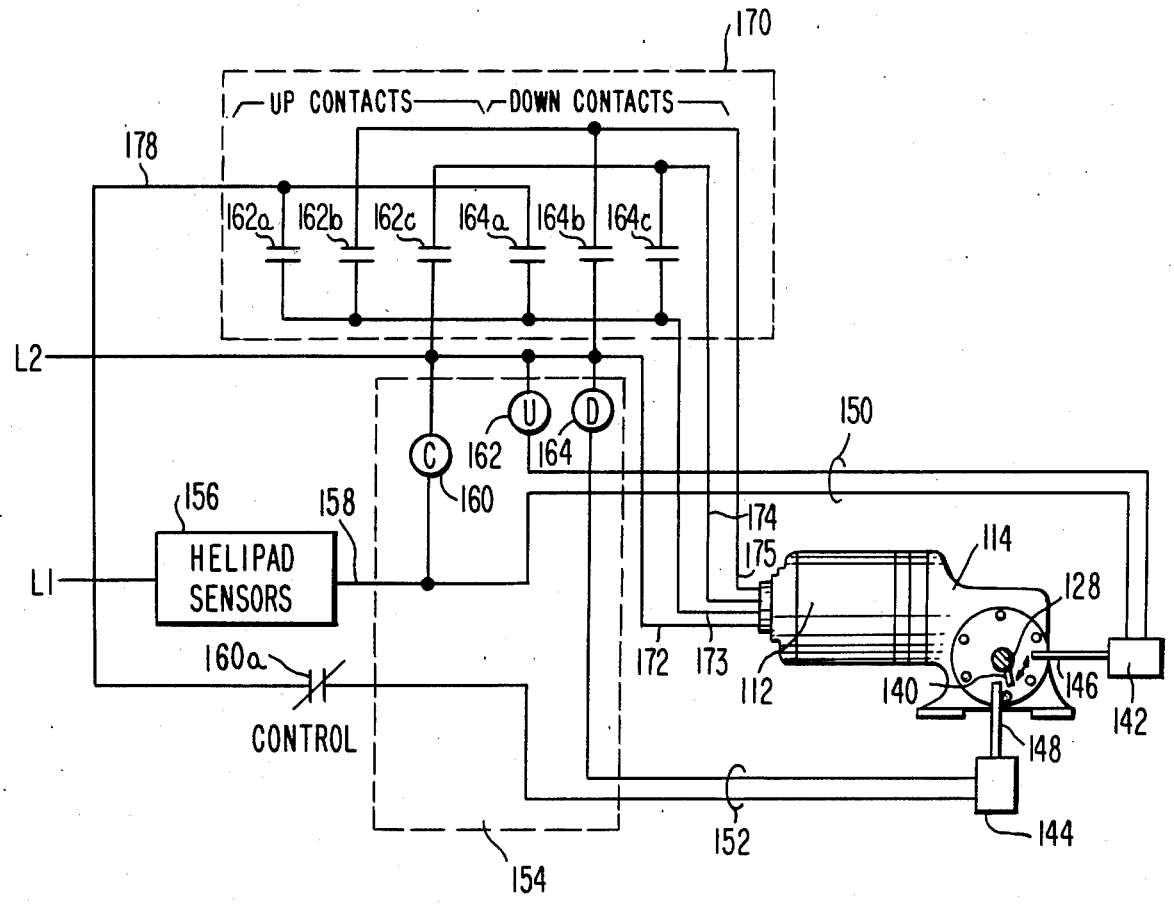
FIG. 7 is a diagrammatic view of the electrical drive circuit for the drive motor for the safety railing of the present invention.

A control circuit for the drive motor 112 is illustrated in FIG. 7. As there shown, the pivot shaft 128 is provided with a suitable position indicator mechanism, such as a cam arm 140. The cam arm may be mounted on the pivot shaft and rotates with that shaft. Shaft position detectors such as microswitches 142 and 144 are mounted adjacent the shaft 116, and include detector arms 146 and 148, respectively, positioned to be contacted by the cam arm 140 to activate the respective switches. Thus, rotation of the shaft 116 in a counterclockwise direction, as viewed in FIG. 7, will cause the arm 140 to contact detector arm 146 to activate switch 142, thereby providing an indication that the pivot shaft has reached a first position, which may correspond to an upright positioning of the railing 26. In similar manner, rotation of shaft 116 in the opposite direction brings arm 140 into contact with detector arm 148 to thereby activate switch 144. This provides an indication of a second position of the drive shaft, which may correspond to the horizontal location of the railing illustrated in dotted lines in FIG. 4.

Microswitches 142 and 144 are connected by way of lines 150 and 152, respectively, to a motor control circuit 154 which is connected through a plurality of helipad sensors 156 to a source of power connected across lines L1 and L2. The sensors 156 are located on the helipad and are responsive to the presence of a helicopter. The sensors 160 may be a plurality of electric pressure pads, for example, located at spaced locations on the surface of the helipad, so that a helicopter landing anywhere on the pad will activate one or more of them, to supply power from supply line L1 to the control circuit 154 by way of input line 158.

The control circuit 154, in a preferred form of the invention, includes three relay coils. A control coil 160 is connected between power line 158 and neutral line L2; an "up" coil 162 connected between power line 158 and neutral line L2 by way of lines 150 and microswitch 142; and a "down" coil 164 connected between power line L1 and neutral line L2 by way of control coil contact 160*a*, lines 152, and microswitch 144. Contact 160*a* is normally closed, but opens upon energization of coil 160, when one of the helipad sensors 156 is closed by the landing of a helicopter. "Up" coil 162 causes motor 112 to rotate in a direction to raise the railing 26 to its operations position upon activation of a helipad sensor while "down" coil 164 causes the motor to rotate in a direction to lower the railing to its normal position.

The control circuit 154 regulates the operation of motor 112 through a motor reversing switch 170, which includes three up coil contacts 162*a*, 162*b*, and 162*c*, and three down coil contacts 164*a*, 164*b*, and 164*c*. The motor reversing switch is connected between the power supply lines L1, L2, and the electric motor input lines 172, 173, 174, and 175, which are conventional reversible motor inputs. Neutral line L2 is connected directly to motor input line 172. Power line L1 is connected by way of line 178 through the normally open contacts 162*a* and 164*a* to motor input line 173. Line 173 is also connected through normally open contact 162*b* to motor input line 175, while neutral line 172 is connected through normally open contact 164*b* to line 175, so that power line L1 is connected to line 175 during an "up" cycle, while neutral line 172 is connected line 175 during a "down" cycle. Finally, neutral line 172 is connected through normally open contact 162*c* to motor line 174, and motor input line 173 is connected through normally open contact 164*c* to motor input line 174, so that power is connected to line 174 during a down cycle and neutral is connected to line 174 during an up cycle. By means of the reversing switch 170, then, the power supply lines to 174 and 175 is reversed, to drive the motor in one direction or the other.

In operation, the sensors 156 are normally open in the absence of a helicopter on the helipad 12. In this condition, power from line L1 is supplied through normally closed control contact 160*a* and microswitch 144 to energize the down coil 164. This closes contacts 164*a*, 164*b*, and 164*c*, supplying power to motor input line 174, connecting the neutral line L2 to motor input line 175, and driving the motor in a first direction to rotate shaft 128 in a clockwise direction (as viewed in FIG. 4), to lower the railing. When the railing reaches the down position, arm 140 opens microswitch 144 to deenergize coil 164.

When a helicopter lands on one of the sensors 156, power is supplied to control 160, to open contact 160*a* and to disable coil 164. Power is also supplied through microswitch 142 (now closed) to energize coil 162, thereby closing contacts 162*a*, 162*b*, and 162*c*. This supplies power from L1 to motor input line 175, and connects the neutral to line 174, thereby energizing motor 112 to run in a second direction to rotate shaft 128 in a counterclockwise direction (as viewed in FIG. 4). This raises the railing 26 until it reaches the vertical, at which time microswitch 142 is opened, deenergizing coil 162 and disabling the motor. Although the "down" circuit microswitch is now closed, the motor remains inactive, as long as control coil 160 holds contact 160*a* open. When the helicopter leaves the pad, sensors 156 open, coil 160 is deenergized, the down coil 164 is energized, and the motor 112 is immediately activated to lower the railing. The motor will drive the pivot shaft 128 in the clockwise direction, until arm 140 activates microswitch 144, indicating that the railing has returned to its horizontal position. At this time, the control circuit 154 will again turn off the motor, with the motor remaining deactivated until the next activation of one of the sensors 156. Accordingly, the railing 26 is raised and lowered with the landing and taking off of a helicopter, to provide protection for crew and passengers on the surface of the helipad, without endangering the helicopter.

Although the present invention has been described in terms of a preferred embodiment, it will be apparent to those of skill in the art that numerous variations and modifications may be made without departing from the true spirit and scope thereof, as defined in the following claims.

I claim:

1. A movable safety railing, comprising:

a helicopter landing pad platform;

an access stairway and a stairway landing connected to said platform to provide access to said pad;

a pivot means;

means securing said pivot means to an edge of said stairway landing for pivotal motion with respect thereto;

railing means secured to said pivot means for pivotal motion therewith, said railing means extending along an edge of said stairway landing and along at least a portion of said stairway;

drive means selectively operable in first and second directions between first and second positions to drive said railing means between a first horizontal position and a second vertical position; and sensor means for actuating said drive means, said sensor means being responsive to a first condition to operate said drive means in said first direction to drive said railing means to said first position, and being responsive to a second condition to drive said railing means in a second direction to said second position.

2. The moveable safety railing of claim 1, wherein said sensor means includes means responsive to the absence of a helicopter on said landing pad to operate said drive means to drive said railing means in said first direction, and responsive to the presence of a helicopter on said landing pad to operate said drive means to drive said railing means in said second direction.

3. The moveable safety railing of claim 2, wherein said sensor means includes pressure-sensitive means located on said landing pad.

4. The moveable safety railing of claim 2, wherein said drive means comprises a reversible electric motor.

5. The moveable safety railing of claim 2, wherein said pivot means includes a pivot shaft mounted along said edge of said landing, and wherein said drive means is connected to rotate said pivot shaft.

6. The moveable safety railing of claim 5, wherein said railing includes at least one post member secured to said pivot shaft and extending, when said railing is vertical, with one end above said landing and the other end below said landing, said post member carrying at its upper end a handrail portion and carrying at its lower end a counterweight to facilitate rotation of said railing between its horizontal and vertical positions.

7. The moveable safety railing of claim 5, further including first and second limit switch means for deactivating said drive means when said shaft reaches said first and said second positions, respectively.

8. The moveable safety railing of claim 7, wherein said drive means is a rotating drive motor connected to said pivot shaft through reduction gears.

9. The moveable safety railing of claim 7, wherein said drive means includes a linear drive motor connected to said pivot shaft through a crank arm.

10. The moveable safety railing of claim 2, further including control means responsive to the position of said railing for selectively actuating said drive means in said first or second directions.

11. The moveable safety railing of claim 10, wherein said control means includes first and second detectors responsive to the position of said railing, a control circuit responsive to said detectors, and a reversing circuit responsive to said control circuit to regulate the direction of said drive means.

12. A moveable safety railing, comprising:

a platform to be protected;

railing means pivotally connected to at least one edge of said platform;

motor drive means selectably operable to pivot said railing means between a first, retracted position and a second, safety position, said railing means being normally in said retracted position; and sensor means responsive to a first condition on said platform for activating said motor drive means to pivot said railing means to said safety position, and responsive to a second condition on said platform for pivoting said railing means to said retracted position, whereby said railing is pivoted to its safety position under predetermined conditions to safeguard users of said platform.

13. The moveable safety railing of claim 12, further including access stairway means for said platform, said railing means extending along at least a portion of said stairway means to safeguard users of said stairway means.

14. The movable safety railing of claim 13, further including pivot means connected to said platform, said railing means being mounted on said pivot means for pivotal motion with respect to said platform.

15. The moveable safety railing of claim 14, wherein said platform includes a stairway landing for said stairway means.

16. The moveable safety railing of claim 15, wherein said railing means extends along at least said stairway landing portion of said platform.

* * * * *